US008226345B2

(12) United States Patent
De Leo

(10) Patent No.: US 8,226,345 B2
(45) Date of Patent: Jul. 24, 2012

(54) DEVICE FOR PROCESSING MAIL ITEMS IN BUNDLES

(75) Inventor: Guido Teodoro De Leo, Genoa (IT)

(73) Assignee: Elsag Datamat SpA, Genoa (IT)

( * ) Notice: Subject to any disclaimer, the term of this patent is extended or adjusted under 35 U.S.C. 154(b) by 485 days.

(21) Appl. No.: 12/428,548

(22) Filed: Apr. 23, 2009

(65) Prior Publication Data

US 2009/0269173 A1 Oct. 29, 2009

(30) Foreign Application Priority Data

Apr. 24, 2008 (IT) ..... TO2008A0318

(51) Int. Cl.
*B65G 57/00* (2006.01)

(52) U.S. Cl. ..... 414/790.3; 414/789; 53/540; 53/243; 198/403

(58) Field of Classification Search ..... 53/540, 53/242, 243, 392; 414/790.2, 789; 198/403
See application file for complete search history.

(56) References Cited

U.S. PATENT DOCUMENTS 2,833,099 A * 5/1958 Rejsa ..... 53/243
3,757,486 A * 9/1973 Feurston et al. ..... 53/535
3,779,410 A * 12/1973 Phillips et al. ..... 414/418
4,124,126 A * 11/1978 Abraham ..... 414/758
4,236,855 A * 12/1980 Wagner et al. ..... 414/789.5
4,549,845 A * 10/1985 Ramsey, Jr. ..... 414/620
4,573,863 A * 3/1986 Picotte ..... 414/763
4,693,051 A * 9/1987 Mattei et al. ..... 53/148
4,798,278 A * 1/1989 Cornacchia ..... 198/399
4,884,675 A * 12/1989 Muraro et al. ..... 198/358
4,936,816 A * 6/1990 Blumle et al. ..... 493/183
5,007,227 A * 4/1991 McClusky et al. ..... 53/243
5,115,625 A * 5/1992 Barbulesco et al. ..... 53/467
5,136,826 A * 8/1992 Carson et al. ..... 53/443
5,360,309 A * 11/1994 Ishiguro ..... 414/404
5,379,571 A * 1/1995 Gottfreid ..... 53/471
5,386,677 A * 2/1995 Kobuki et al. ..... 53/251
5,437,534 A * 8/1995 Gales ..... 414/789.9
5,720,156 A * 2/1998 Bridges et al. ..... 53/438
5,727,365 A * 3/1998 Lashyro et al. ..... 53/448
5,862,649 A * 1/1999 Benz ..... 53/447
5,888,045 A * 3/1999 Schmeisser et al. ..... 414/626
5,893,258 A * 4/1999 Lancaster, III ..... 53/399
6,070,398 A * 6/2000 Neri ..... 53/582
6,134,865 A * 10/2000 Long ..... 53/540
6,305,728 B1 * 10/2001 Holter et al. ..... 294/3
6,398,008 B1 * 6/2002 Suga ..... 198/404
6,584,754 B1 * 7/2003 Neri ..... 53/540
6,658,816 B1 * 12/2003 Parker et al. ..... 53/397
6,679,033 B2 * 1/2004 Hart et al. ..... 53/475
6,792,741 B1 * 9/2004 Theriault ..... 53/443
6,793,454 B2 * 9/2004 Brizzi ..... 414/767
6,896,471 B2 * 5/2005 Svyatsky et al. ..... 414/421
6,968,668 B1 * 11/2005 Dimario et al. ..... 53/242
7,093,408 B2 * 8/2006 Duperray et al. ..... 53/398
7,596,926 B2 * 10/2009 Schulte et al. ..... 53/167
7,780,396 B2 * 8/2010 Hendricks et al. ..... 414/802
7,788,886 B2 * 9/2010 Aquarius ..... 53/502
7,856,797 B2 * 12/2010 Black et al. ..... 53/447

* cited by examiner

*Primary Examiner* — Joseph A Dillon, Jr.
(74) *Attorney, Agent, or Firm* — Berenato & White, LLC

(57) ABSTRACT

A device for processing mail items, having: at least one stacking device for forming a bundle of superimposed mail items and moving it from a forming position to a loading position; one or more robots for removing the bundles in the loading position and moving them into a covering position; one or more covering devices for placing upside down containers over the bundles in the covering position, so the bundles of mail items are housed inside the containers; a conveying system supplied by the covering devices with bundles of mail items covered with respective upside down containers; and a turnover device for turning the containers over through 180°, so the containers are positioned with their respective openings facing upwards.

24 Claims, 17 Drawing Sheets

DEVICE FOR PROCESSING MAIL ITEMS IN BUNDLES

This application relates to Italian Patent application no. TO2008A 000318 filed on Apr. 24, 2008, of which the disclosures are incorporated herein by reference and to which priority is claimed under 35 § U.S.C. 119.

The present invention relates to a device for processing mail items in bundles.

BACKGROUND OF THE INVENTION

Devices are known for forming bundles of mail items (letters, postcards, enveloped documents, folded newspapers, etc.) comprising a number of predominantly flat mail items stacked substantially parallel.

The bundles are then normally loaded by hand into standard containers for further processing or dispatch from the automated mail sorting plant.

So-called automatic emptying systems are known, by which the bundles of mail formed on the bundling devices are extracted and made available for further processing.

Different types of known devices share various drawbacks:

high device cost;

difficulty in processing bundles of dissimilar items, due to current standards accommodating widely differing mail items;

small bundle size processable; and the way in which the bundles are packed for dispatch, which does not always make for easy transport or simplifying further processing at the receiving office.

Moreover, some known devices employ non-standard, special containers, which are expensive, and mean the bundles must later be transferred to standard containers.

A need is therefore felt for a device that:

is low-cost;

employs bundling devices capable of accommodating widely differing mail items and preventing fall-out of mail items from the bundle;

employs containers currently used by each mail network (standard containers);

provides for reliable, labour-free, automatic bundle transfer.

SUMMARY OF THE INVENTION

It is an object of the present invention to provide an automatic integrated system comprising a device for processing bundles of mail items easily, reliably and cheaply.

According to the present invention, there is provided a device for processing mail items in bundles, as claimed in the attached claims.

BRIEF DESCRIPTION OF THE DRAWINGS

A preferred, non-limiting embodiment of the present invention will be described by way of example with reference to the accompanying drawings, in which:

FIGS. 8*a*-8*l* show, schematically, operation of a variation of the device according to the present invention.

DETAILED DESCRIPTION OF THE INVENTION

Figure 1:
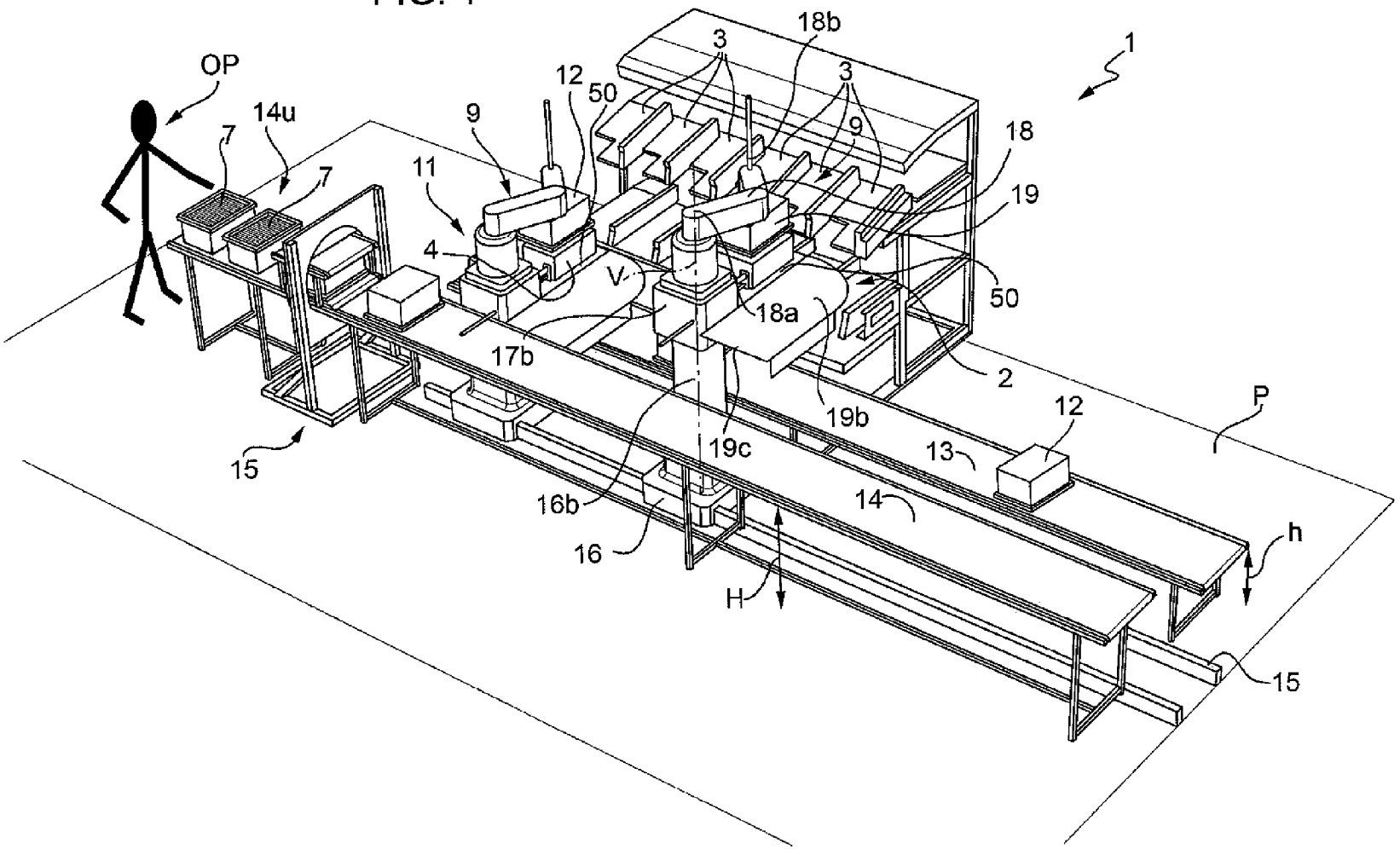
FIG. 1 shows a view in perspective of a device for processing mail items in bundles, in accordance with the teachings of the present invention.

Number 1 in FIG. 1 indicates as a whole a device for processing mail items in bundles, and comprising:

a number of stacking devices 3 (twelve, in the example shown, arranged side by side on two levels), each for forming in known manner (hence, stacking devices 3 are not described in detail) a bundle 4 of flat mail items 7 (letters, postcards, enveloped documents, folded newspapers, etc.) arranged substantially parallel; by means of a pusher 2 (described in detail below), each stacking device 3 also provides for moving the finished or partly finished bundle 4 from a forming position to a loading position;

a number of (in the example shown, two) robots 9, which engage stacking devices 3 one at a time to remove the bundle 4 of mail items 7 in the loading position and move it into a covering position;

a number of (in the example shown, two) covering devices 11, each of which supports a respective robot 9 and is designed to place a standard container 12 upside down over the bundle 4 of mail items in the covering position, so the bundle of mail items is housed inside the upside down container 12 (the term standard container is intended to mean a container generally used by national Postal Administrations at automated sorting plants; in Europe, they are normally made of rigid plastic with practically vertical walls; in the United States of America, they are normally made of less rigid material, such as cardboard or similar plastic materials, with slightly flared walls; they normally comprise a bottom and four fixed lateral walls, and are of given sizes, depending on the postal network);

a feed system 13 for supplying empty standard containers 12, and comprising a first straight conveyor belt on a first side of covering devices 11, between the covering devices and stacking devices 3—covering devices 11 pick up the upside down containers one at a time off conveyor belt 13;

a shared conveyor system 14 onto which the two covering devices 11 unload bundles 4 of mail items covered with respective upside down containers 12, and which comprises a second straight conveyor belt on a second side of covering devices 11; and a turnover device 15 located close to the output end 14*u* of shared conveyor system 14 to turn the upside down containers 12 over 180°, so the containers 12 fed to the output of conveyor system 14 are positioned with respective openings facing upwards, and are either interfaced with a container processing system, or can be gripped and handled easily by an operator OP at the end of conveyor system 14.

Conveyor belts 13 and 14 are parallel, and define respective supporting surfaces; the supporting surface of conveyor belt 14 being at a greater height H than the height h of the supporting surface of conveyor belt 13 off a level floor P on which device 1 stands.

Each covering device 11 moves along a straight rail 15*g* fixed firmly to floor P and extending between and parallel to first conveyor belt 13 and second conveyor belt 14.

Each covering device 11 comprises:

- a first powered slide 16 movable back and forth along straight rail 15*g* by drive means (not shown);
- a vertical, rectangular-section post 16*b* having a bottom first end connected to first powered slide 16; and a top second end, along which a second powered slide 17*b* moves vertically up and down (along an axis V coincident with the axis of post 16*b*);
- an articulated arm 18 comprising two hinged straight portions, and having a first end 18*a* fitted to second slide 17*b* and rotatable about axis V;
- a gripper 19 fitted to a free end 18*b* of articulated arm 18 to engage (in known manner, e.g. by means of suction cups—FIG. 5*g*) and remove a container 12 off first conveyor belt 13—gripper 19 is movable to and from the free end by actuating means, and in a direction parallel to axis V; and
- a roughly L-shaped supporting surface 19*b* fitted to second slide 17*b*, with its longer leg extending crosswise to belts 13 and 14—supporting surface 19*b* has a straight edge 19*c* parallel to a straight edge portion of conveyor belt 14.

In actual use, articulated arm 18 is rotated to position gripper 19 over a container 12 on first conveyor belt 13; gripper 19 is lowered to attach the suction cups to an upward-facing wall of container 12 (FIG. 5*g*), and is then lifted back up to lift container 12 off conveyor belt 13.

First powered slide 16 moves along rail 15*g* to position a flat rectangular portion 50 (detailed below) of supporting surface 19*b* facing a first- or second-level stacking device 3, depending on the axial position of second slide 17*b* along post 16*b*; in which position, robot 9 is also positioned facing the same stacking device 3.

As explained below, robot 9 moves bundle 4 of mail items 7 from stacking device 3 onto portion 50 of supporting surface 19*b* (from the loading position to the covering position).

Articulated arm 18 is then positioned over the bundle 4 of mail items, and container 12 is lowered over bundle 4 in the covering position and onto supporting surface 19*b* (rectangular portion 50).

Arm 18 is then rotated roughly 180° to slide bundle 4 of mail items 7, housed inside container 12, along supporting surface 19*b*, which is low-friction to maintain contact between container 12 and surface 19*b*, and later belt 14, and so prevent fallout of items 7 in bundle 4 from the enclosure defined by upside down container 12 and supporting surface 19*b*.

Arm 18 comes to a stop as container 12 slides off surface 19*b* onto conveyor belt 14, thus transferring bundle 4 from covering device 11 to shared conveyor system 14. During transfer, supporting surface 19*b* is exactly on a level with conveyor belt 14 (the vertical position of the supporting surface is adjusted by adjusting the position of second powered slide 17*b* along post 16*b*).

Arm 18 then releases bundle 4 on conveyor belt 14, moves back up, and repeats the container-gripping and bundle-removing sequence as described above.

Conveyor belt 14 now feeds bundle 4 of mail items, housed inside container 12, to turnover device 15.

Figure 2:
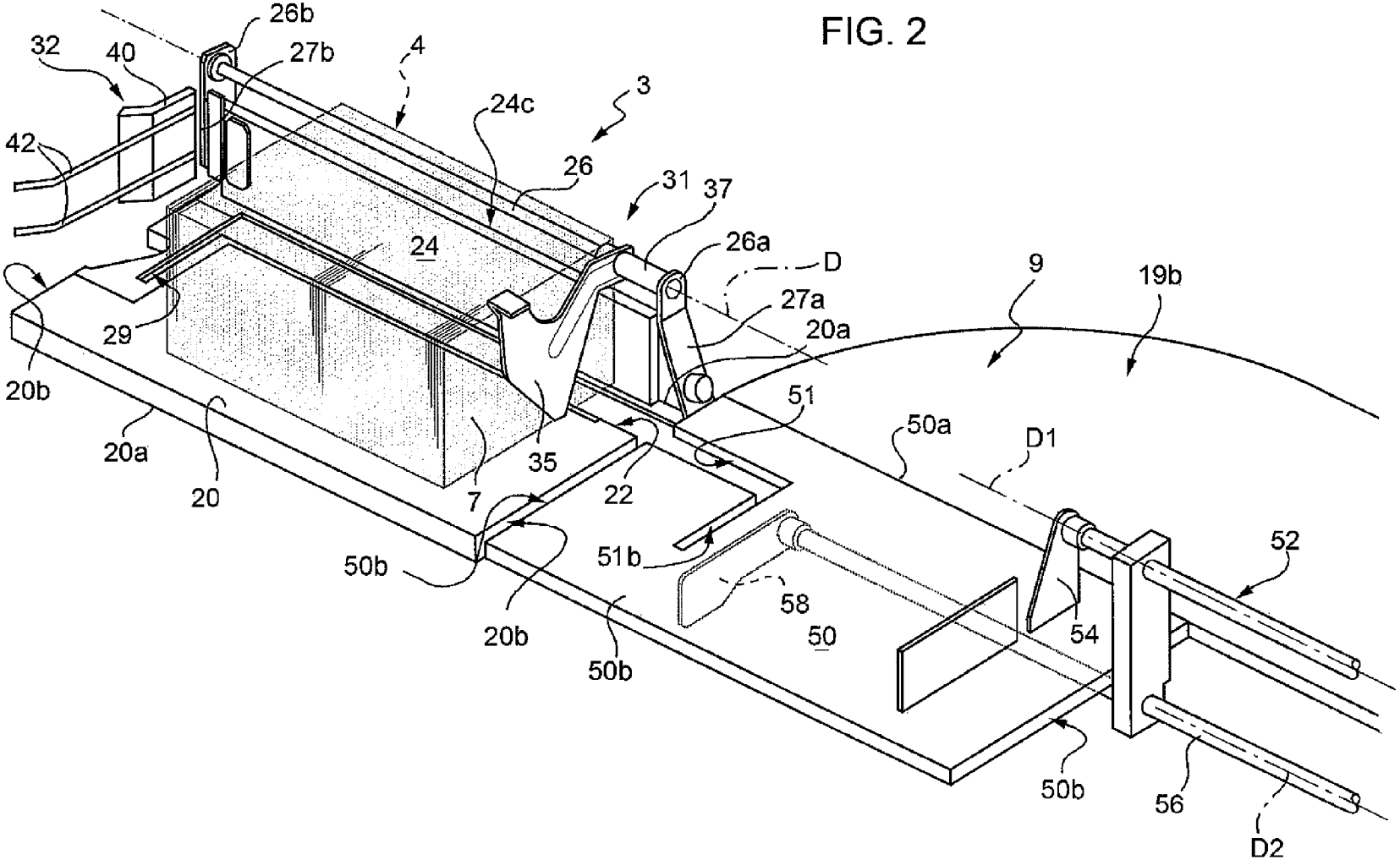
FIG. 2 shows a larger-scale view in perspective of a first detail of the FIG. 1 device.

FIG. 2 shows a detail of a stacking device 3 (stacking devices 3 are all identical and operate in the same way) and part of robot 9.

Stacking device 3 comprises a horizontal, flat rectangular supporting wall 20 bounded by straight long-side edges 20*a* and straight short-side edges 20*b*, and fitted to a supporting structure (not shown). In the non-limiting embodiment shown, wall 20 of stacking device 3 has a straight central gap 22 parallel to edges 20*a* and extending substantially the whole length of supporting wall 20 occupied by a bundle 4 of mail items (e.g. from 50 to 85 cm, depending on the maximum permitted size of bundle 4).

Stacking device 3 also comprises a flat rectangular side wall 24, which extends the whole length of the right straight edge 20*a* and is perpendicular to flat supporting wall 20. Rectangular side wall 24 is fitted on top with a straight rail in the form of a rod 26, of axis D, parallel to edges 20*a* and having end portions 26*a*, 26*b* fitted to respective flanges 27*a*, 27*b* projecting upwards from end portions of side wall 24. Rod 26 is spaced a constant distance apart from a free top edge 24*c* of side wall 24.

Rectangular wall 20 has a second straight gap 29 which perpendicularly intersects straight central gap 22, close to a first (rear) short-side edge 20*b* of supporting wall 20, for the purpose explained below.

Stacking device 3 has a front retainer 31 and a rear retainer 32, which engage opposite faces of bundle 4 resting on flat rectangular wall 20, to keep the mail items 7 in bundle 4 substantially perpendicular to flat rectangular wall 20 when forming bundle 4 (in known manner not described in detail).

In other words, retainers 31, 32 keep bundle 4 pressed to hold it together and prevent mail items 7 from separating.

More specifically, front retainer 31 comprises a typically V-shaped blade 35 perpendicular to axis D and having an end portion fixed firmly to a tubular sleeve 37 mounted to slide along rod 26, so blade 35 can slide back and forth linearly along axis D, from one end portion of wall 20 to the other.

Blade 35 is also connected to an elastic device or counterweight (e.g. a spring, not shown) for moving blade 35 into a rest position close to the (rear) end of wall 20 next to gap 29.

Blade 35 can also swing about rod 26 between an engaged position, in which a bottom end of the blade is positioned facing and close to wall 20, and a release position (FIG. 5*c*), in which the blade is well clear of wall 20 and bundle 4.

Rear retainer 32 comprises a blade 40 which extends perpendicularly to side wall 24, close to the rear end of wall 20.

Rear retainer 32 also comprises two rails 42 (for guiding and slowing down mail items 7 to ensure correct stacking at the bottom of bundle 4) which are moved by blade 40 substantially perpendicularly to axis D and parallel to short-side edges 20*b*.

Figure 3:
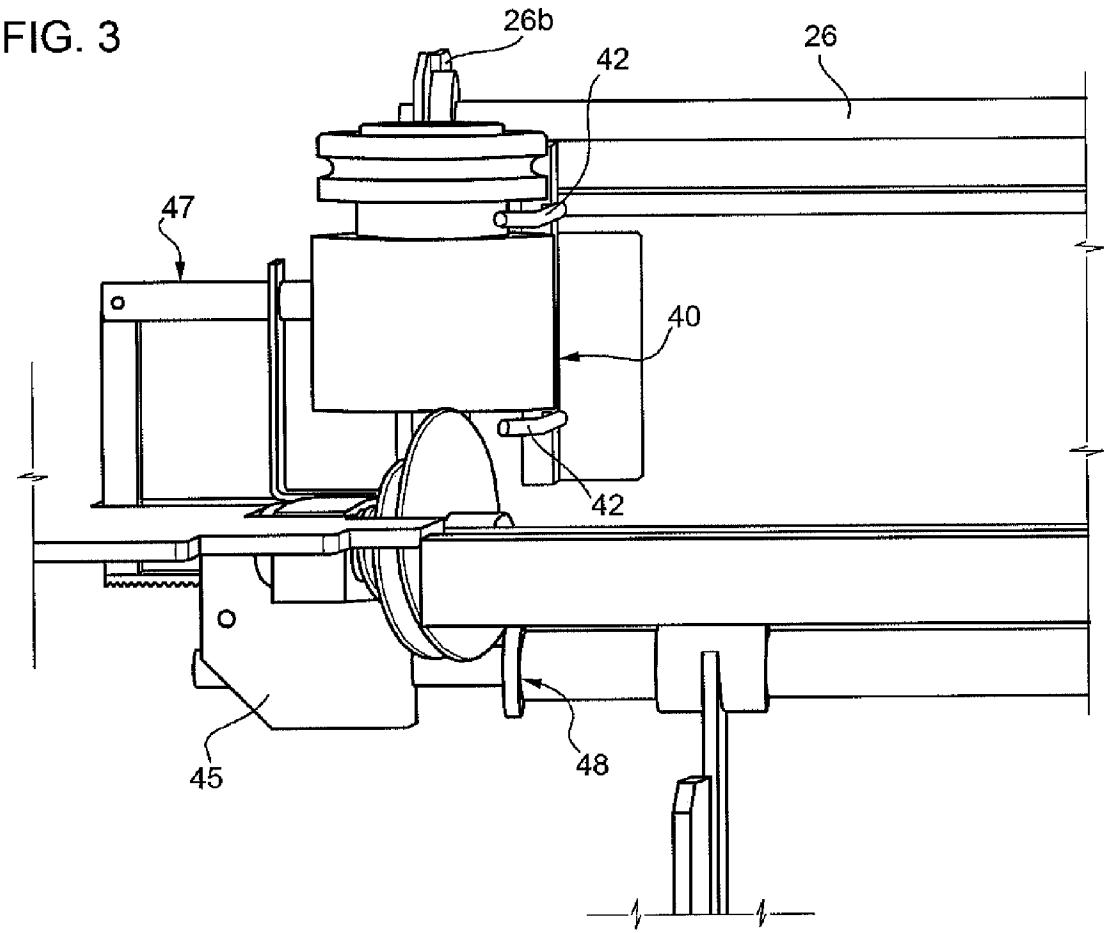
FIGS. 3 and 4 show larger-scale views in perspective of a detail in FIG. 2.
Figure 4:
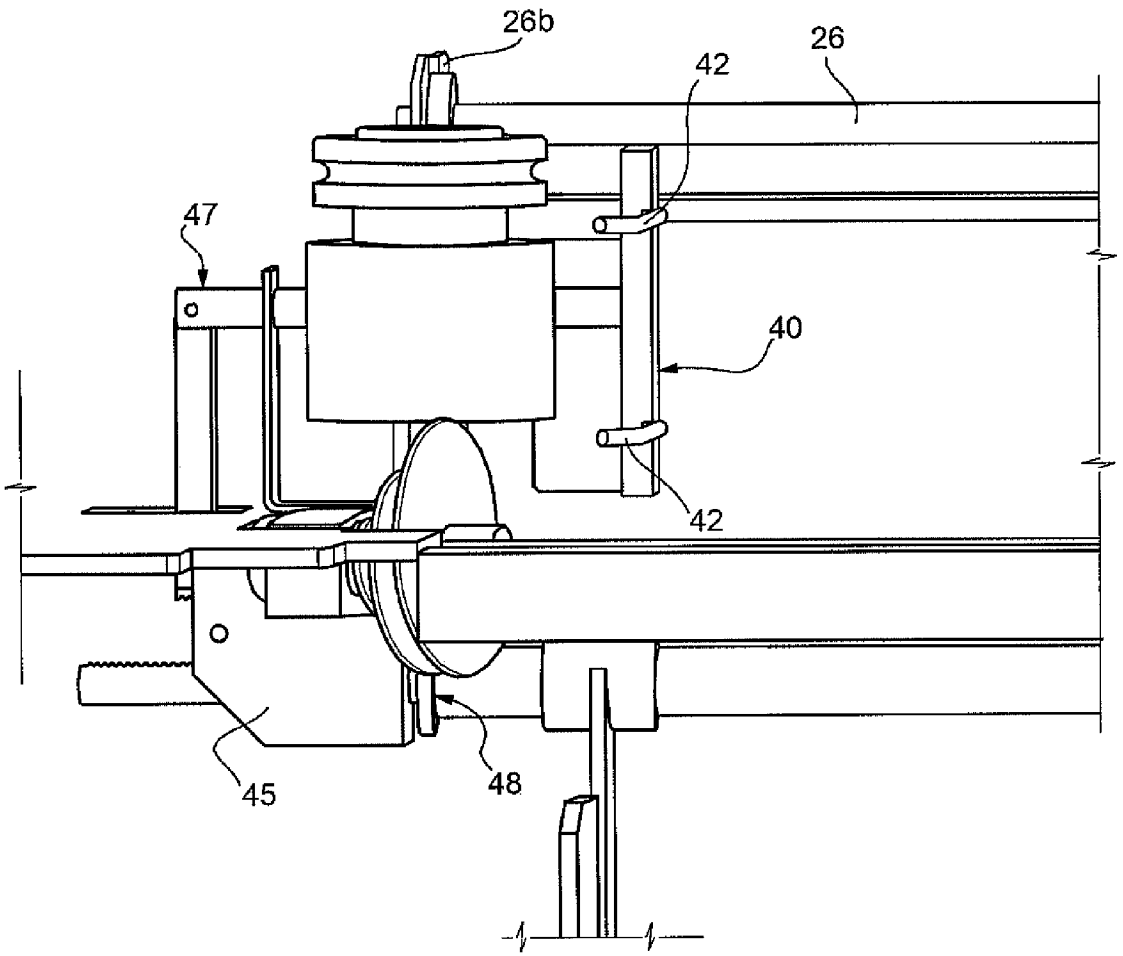

Blade 40 is movable between a rear rest position (FIG. 3) between rear edge 20*b* and gap 29, and a release position (FIG. 4) just past gap 29.

Blade 40 is moved as described above by an actuating system 45 located at one end of wall 20 and comprising an output member 47 movable in a direction parallel to axis D and having a free end integral with blade 40. Actuating system 45 also comprises a button-type input member 48; and a known pinion/rack actuating system (not described in detail) that converts the linear motion of input member 48 to linear motion of output member 47 to move blade 40 from the rest position to the release position and vice versa.

More specifically, pressing input member 48 moves blade 40 from the rest to the release position, and releasing input member 48 moves blade 40 from the release to the rest position, by virtue of the thrust or pull of a known elastic device, e.g. a spring (not shown).

Robot 9 comprises a flat rectangular supporting wall 50 forming part of supporting surface 19*b* (FIGS. 2, 5*a*) and bounded by straight long-side edges 50*a* (parallel to edges 20*a*) and by straight short-side edges 50*b* (parallel to edges 20*b*). Rectangular supporting wall 50 is fitted to slide 17*b*, and faces and is coplanar with wall 20.

Wall 50 has a central rectangular gap 51 extending parallel to straight long-side edges 50*a*, and which is aligned with and the same width as gap 22.

Rectangular wall 50 has a second straight gap 51*b*, which perpendicularly intersects gap 51, close to a first short-side edge 50*b* of supporting wall 50, and the purpose of which is explained below.

Robot 9 comprises a first shaft 52 movable axially back and forth over wall 50 along an axis D1 parallel to axis D. First shaft 52 has a first end (not shown) connected to a known actuator (fitted to slide 17*b* and not shown) for rotating and moving shaft 52 axially; and a second end fitted with a flat paddle 54 perpendicular to shaft 52 and in the shape of a right-angle triangle in the example shown.

Robot 9 comprises a second shaft 56 movable axially back and forth underneath wall 50 along an axis D2 parallel to axis D. Second shaft 56 has a first end (not shown) connected to a known actuator (fitted to slide 17*b* and not shown) for rotating and moving shaft 56 axially; and a second end fitted with a flat paddle 58 perpendicular to shaft 56.

Operation of stacking device 3 and robot 9, connected to covering device 11, to move bundle 4 from the loading position to the covering position will now be described with reference to FIGS. 5*a*-5*g*.

Figure 5A:
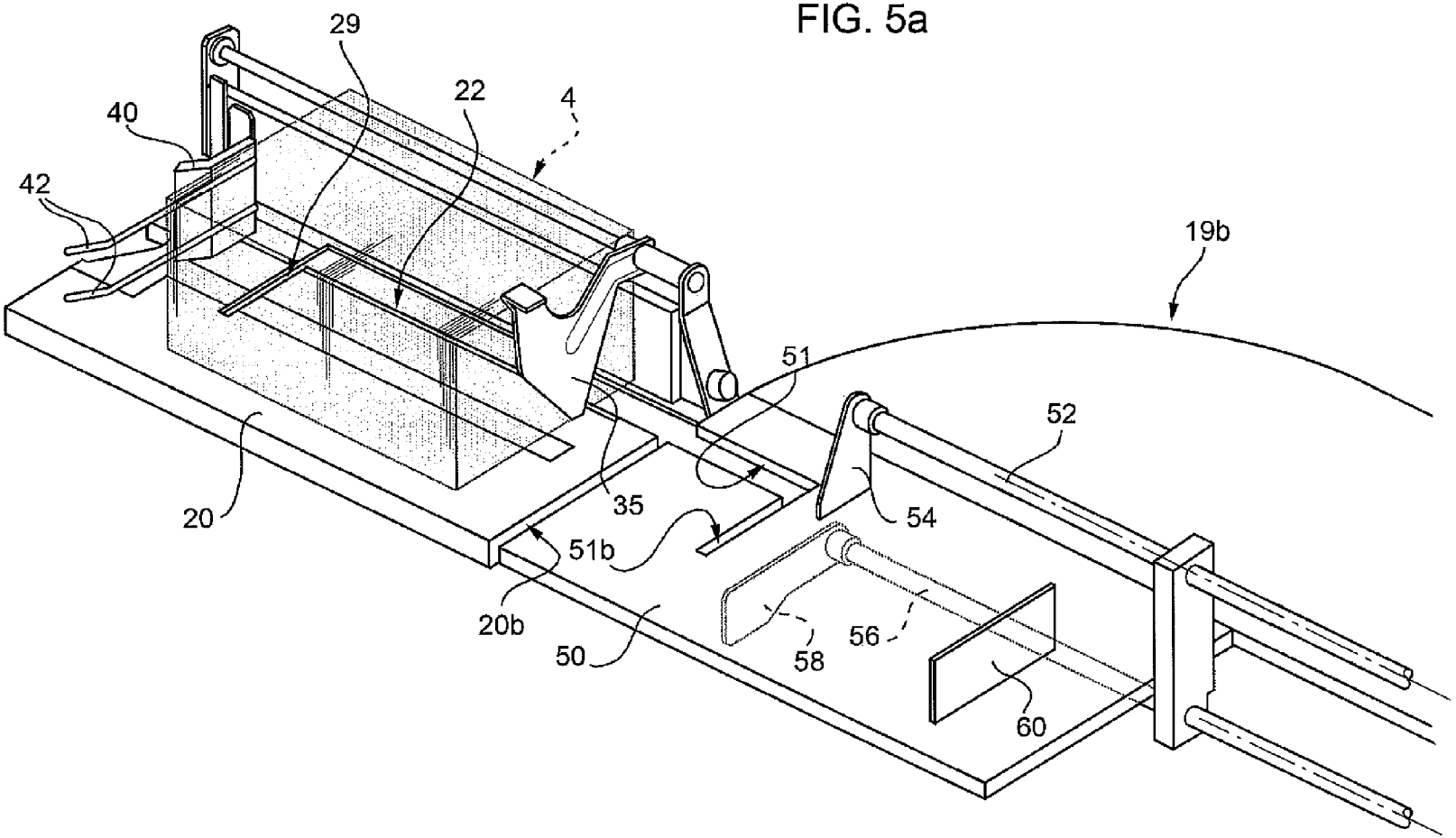
FIGS. 5*a*-5*g* show operating steps performed by the device according to the present invention.

The following steps are performed:

Step 1 (FIG. 5*a*—Stacking Device 3 Full)

On the basis of information concerning fill-up of stacking devices 3 by processing system 1, a control system (not shown) controlling covering device 11 commands this to position slide 16 along rail 15*g* to align robot 9 with the stacking device 3 that is nearly full.

When the stacking device is actually full, bundle 4 is positioned at the front of supporting wall 20 (loading position); blade 40 moves into the release position (at gap 29), so blade 35 (in the engaged position) is pushed towards front edge 20*b*, while still supporting one side of bundle 4.

As robot 9 lines up with the full stacking device 3, shaft 56 positions paddle 58 exactly beneath gap 29 underneath flat wall 20, and shaft 52 positions paddle 54 next to blade 35 on top of flat wall 20.

Blade 35 is kept pressed on the front face of bundle 4 by a counterweight (not shown) which later also moves it back to the rear of wall 20 (i.e. to blade 40—into the rest position).

Figure 5B:
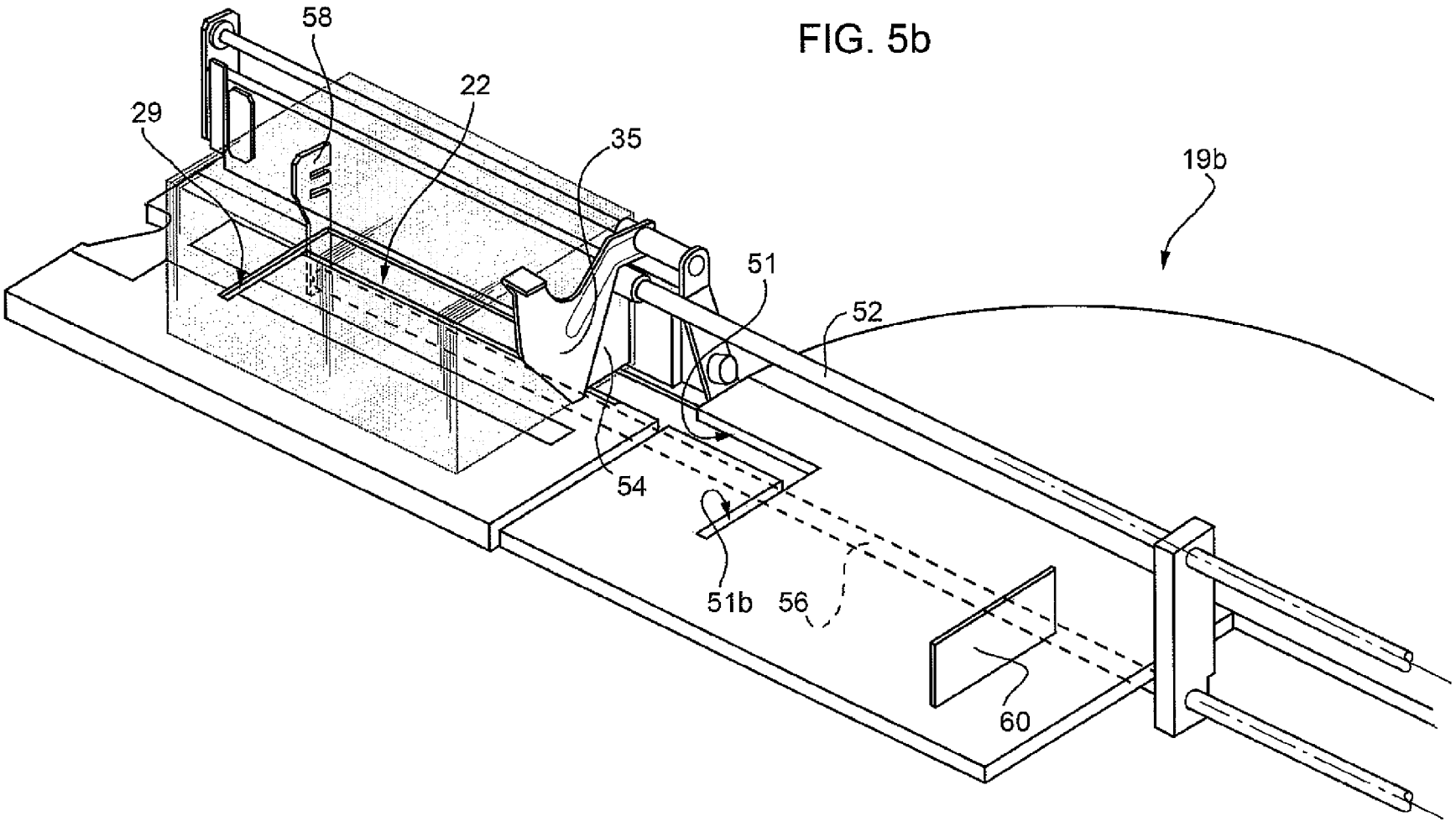

Step 2 (FIG. 5*b*—Robot 9 Prepares to Remove Bundle 4)

With bundle 4 in the loading position on supporting wall 20, shaft 52 is moved axially towards bundle 4 to bring paddle 54 into contact with the front face of bundle 4; in which position, a long side of triangular paddle 54 is positioned contacting one side of blade 35.

Shaft 56 is moved axially and then rotated to bring paddle 58 out through gap 29 and into a position perpendicular to wall 20 and contacting the rear face of bundle 4.

Shaft 56 is backed up (at the same time blade 40 returns to the rest position) to move bundle 4 towards robot 9. Shaft 52 is moved synchronously with shaft 56, and the (front) face of bundle 4 opposite the (rear) face supported by paddle 58 is supported by paddle 54 and blade 35.

Bundle 4 stops moving when blade 35 (and paddle 54) reach the front of wall 20 where the profile (not shown) of rod 26 of blade 35 allows blade 35 to rotate upwards.

Paddle 54 may be designed to avoid taking the first mail items 7 in bundle 4 with it as it rotates. That is, paddle 54 may comprise:

- rollers (e.g. four rollers) arranged (axially radial with respect to rotation of the paddle) to support mail items 7 undisturbed as the paddle rotates; and/or
- a small piston located inside shaft 52, free to rotate smoothly with respect to shaft 52, and which pops out to detach bundle 4 from paddle 54 to allow the paddle to rotate (with the piston stationary) without disturbing mail items 7.

Figure 5C:
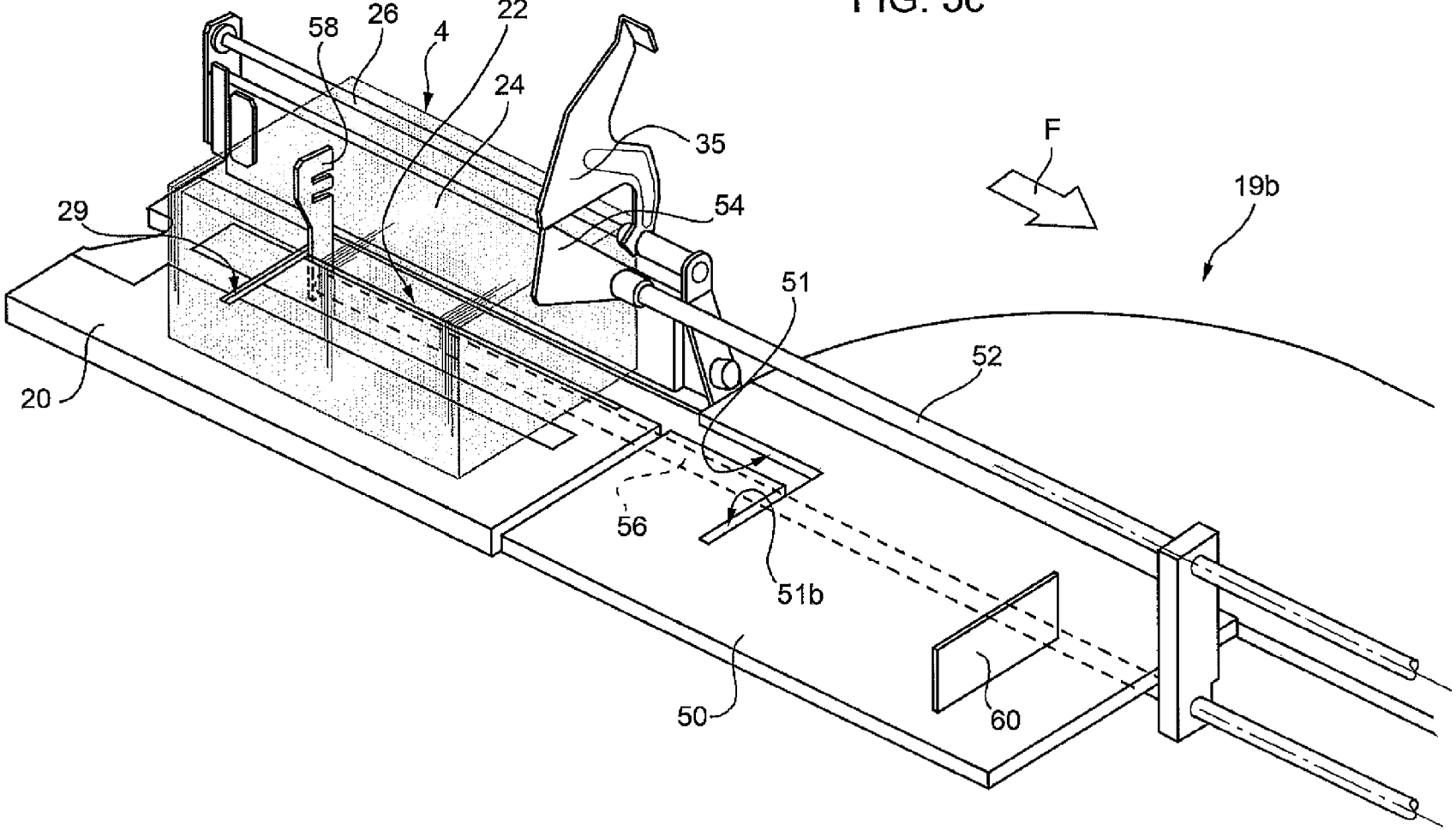

Step 3 (FIG. 5*c*—Robot 9 Rotates Shafts 52 and 56)

With bundle 4 resting on the front portion of supporting wall 20, shaft 52 is rotated a given angle (e.g. 100 degrees) clockwise, so as to rotate blade 35 in the same direction from the engaged to the release position, in which blade 35 no longer contacts the front face of bundle 4, and rod 26 allows rotation of blade 35.

An elastic member or counterweight (not shown) connected to blade 35 moves blade 35 from the release position to the rear rest position. During the return movement of the blade to the rest position, a catch (not shown) extending radially from sleeve 37 engages a guide (not shown), which is parallel to axis D, is formed on a top portion of the side wall, and is straight up to a point close to the rest position.

Blade 35 is thus prevented from rotating about rod 26 as it moves back to the rest position. The straight guide (not shown) curves close to a rear portion of wall 24 to ease rotation of blade 35, with the aid of gravity, into the radially and axially correct rest position facing supporting wall 20. In other words, at the end of its return movement, blade 35 is restored automatically (by gravity) to the rest position.

Paddle 54 is then rotated by shaft 52 in the opposite direction and by a smaller angle than before (e.g. 50 degrees) into a position to better support the front face of bundle 4 of mail items 7.

By the end of the above operations, bundle 4 of mail items 7 is retained by paddles 54 and 58, which have taken over from blades 35 and 40.

Figure 5D:
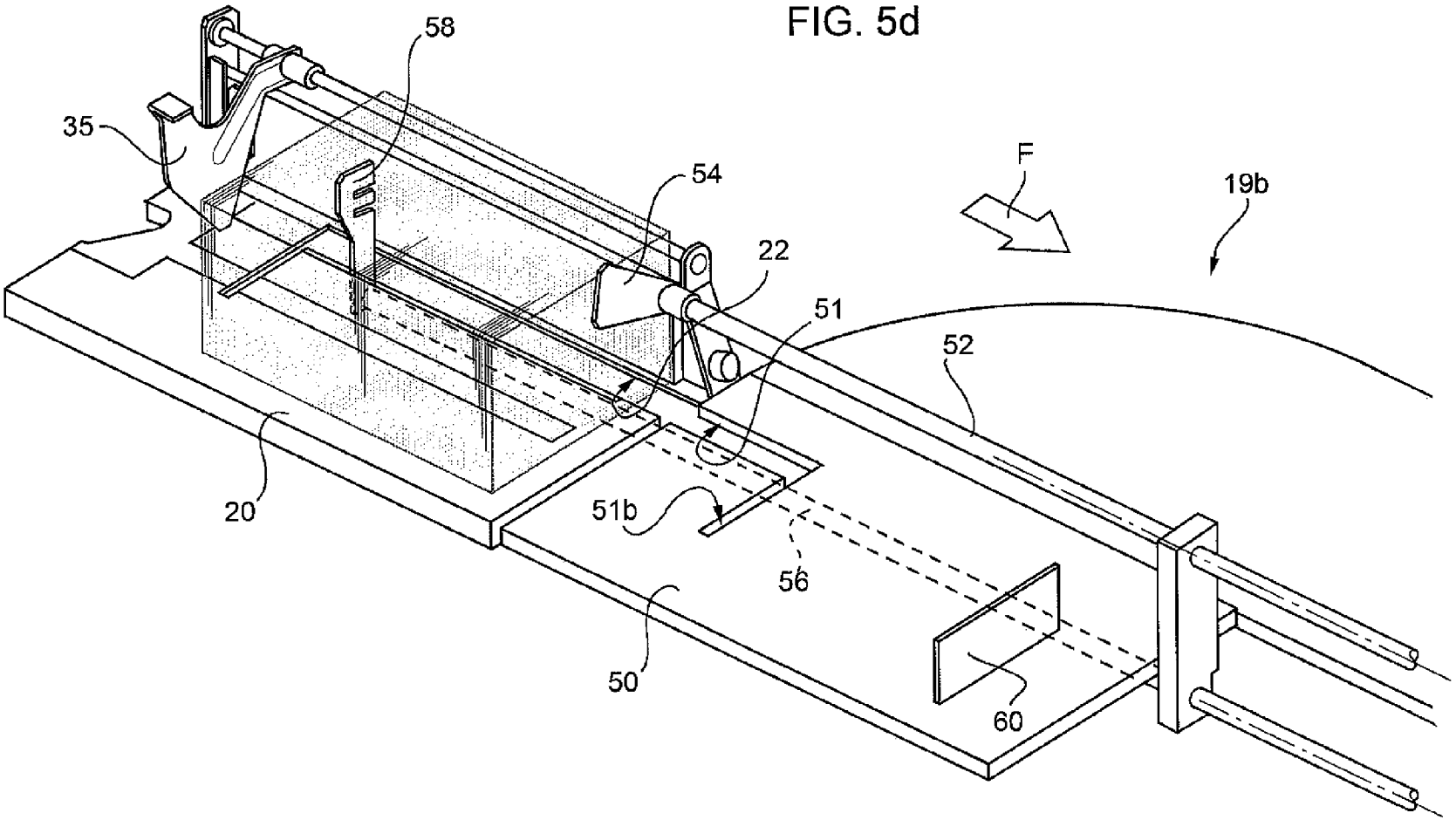

Step 4 (FIG. 5*d*—Second Shift)

Shafts 52 and 56 are moved axially and synchronously at constant speeds by the respective actuators (not shown) in the direction of arrow F (i.e. into the withdrawn position) to move paddles 54, 58 towards wall 50, and bundle 4 from supporting wall 20 onto supporting surface 19*b* (wall 50).

When so doing, paddle 58 slides first along gap 22 and then along gap 51.

Paddle 58 may conveniently be C-shaped (or boomerang-shaped) so that, as it emerges from wall 20 and slides along gap 22, it can support, even the most central parts, the rear face of bundle 4 to stabilize and better control shift of the bundle.

Figure 5E:
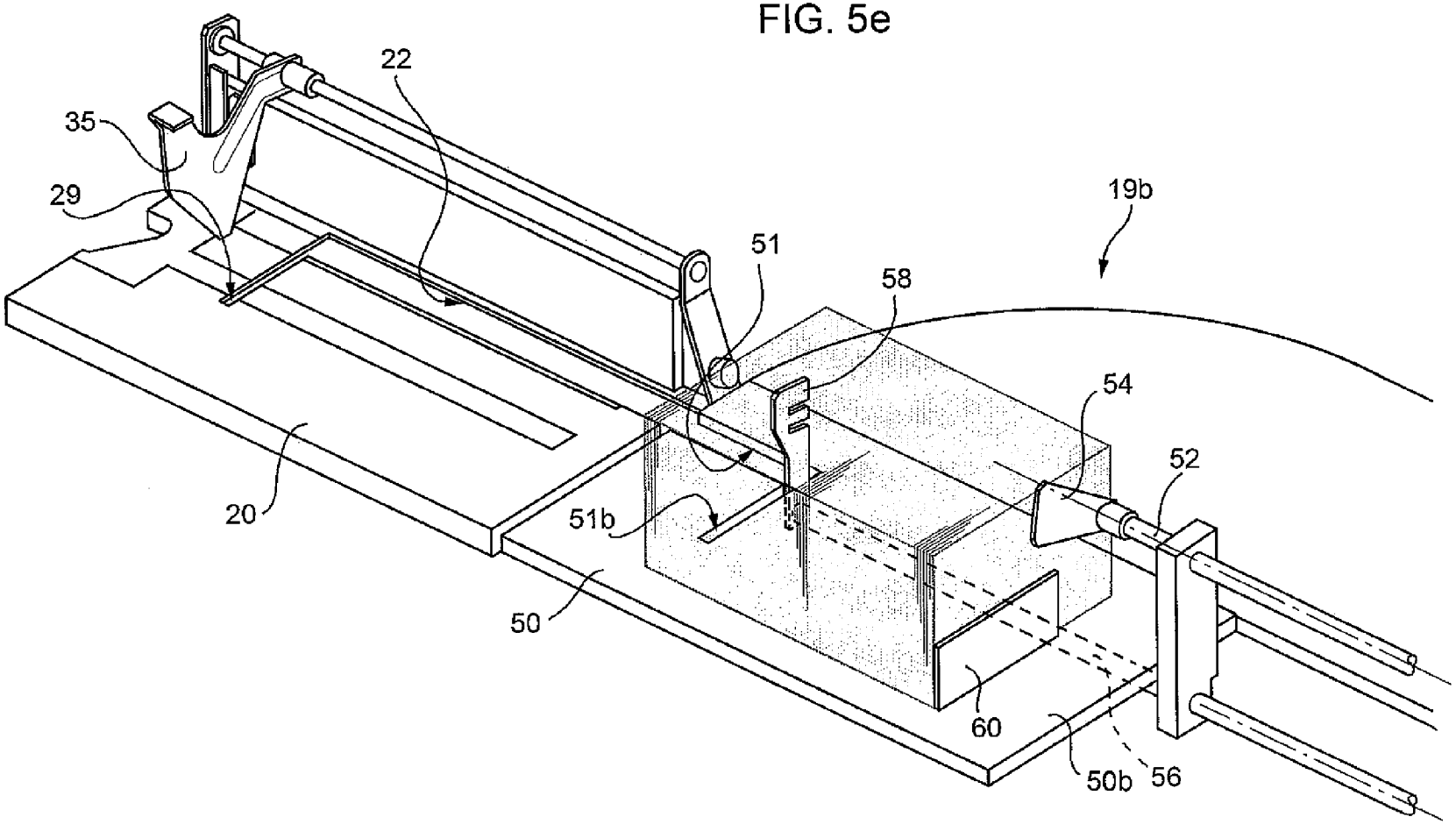
Figure 5F:
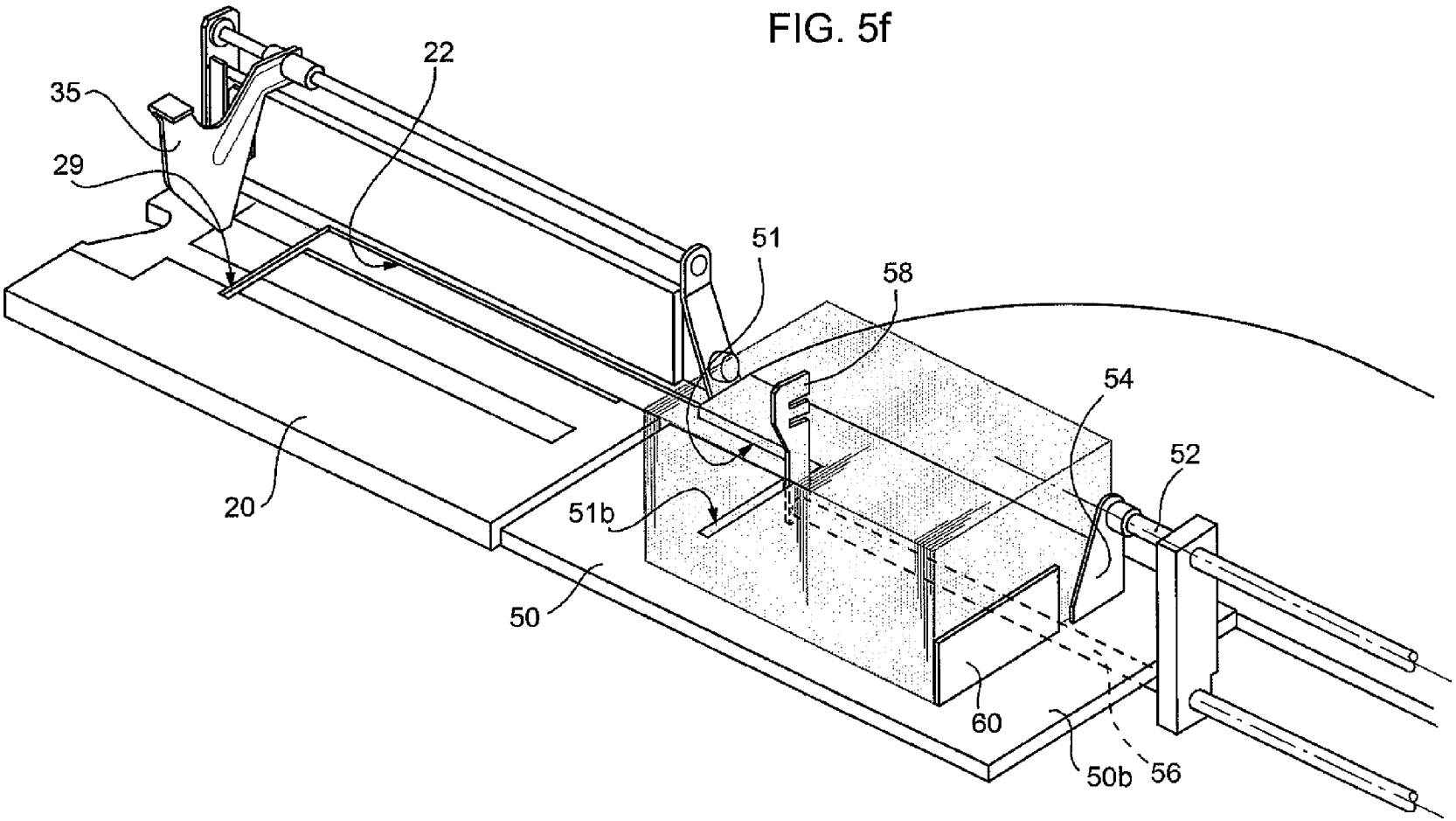

Step 5 (FIG. 5*e*—Final Shift)

Shafts 52 and 56 continue moving synchronously until bundle 4 is positioned entirely on supporting wall 50 and against a stop flange 60 perpendicular to wall 50 and parallel to a short-side edge 50*b*. This represents the covering position of bundle 4. Shaft 52 is then backed up further (FIG. 5*f*) to detach paddle 54 from the front face of bundle 4.

Figure 5G:
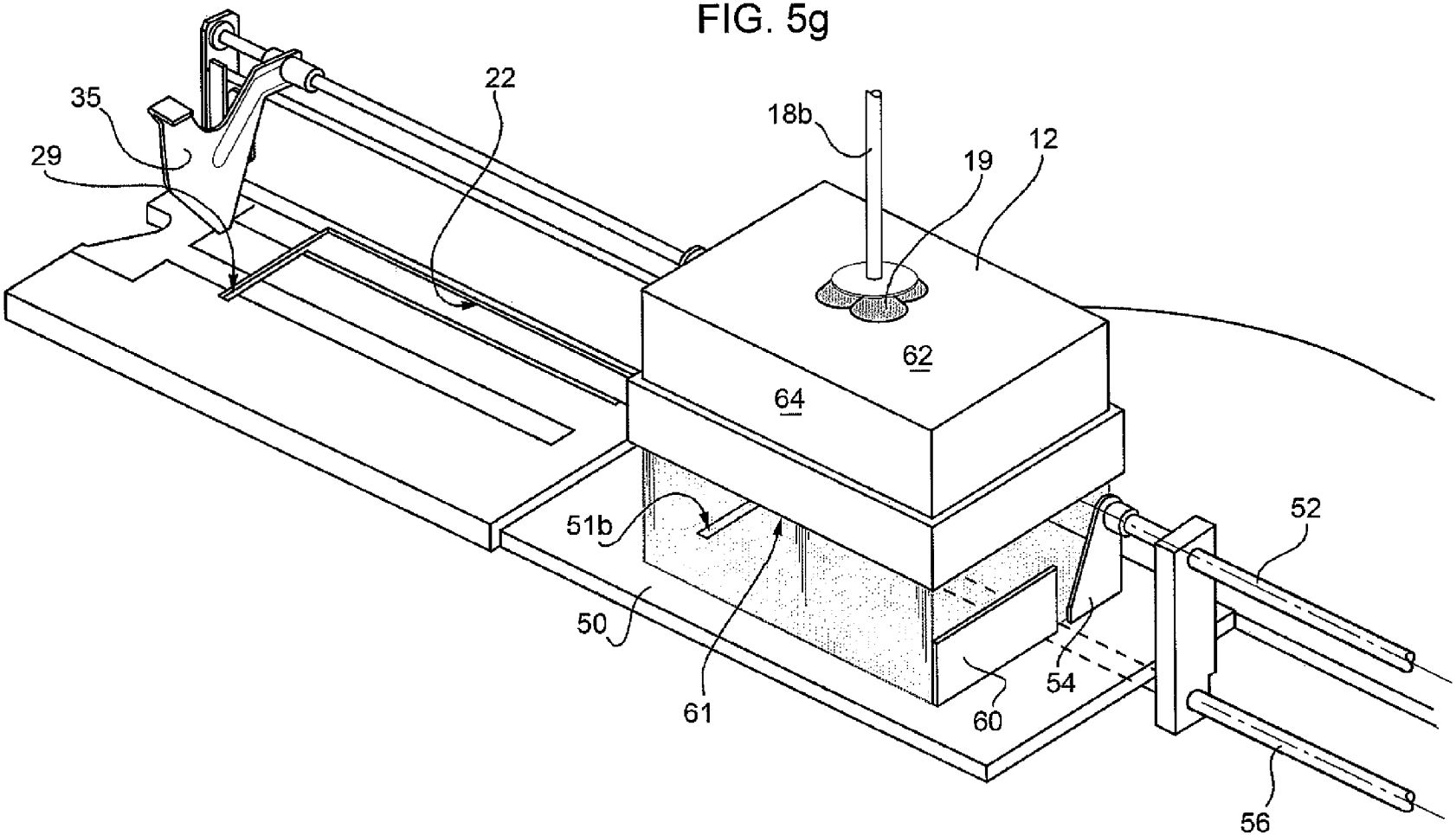

Step 6 (FIG. 5*g*—Applying the Container)

Standard container 12 is placed over bundle 4 in the covering position, so the free peripheral edges 61 of the container rest on wall 50. In the example shown, container 12 is parallelepiped-shaped and bounded by a rectangular bottom wall 62, and four rectangular lateral walls 64 defining a rectangular opening bounded by peripheral edges 61.

After bundle 4 is removed, paddle 58 is rotated anticlockwise back underneath supporting wall 50 through second gap 51*b*

Container 12 containing bundle 4 is then moved by rotating articulated arm 18.

Device 1 according to the present invention is straightforward in design, low-cost, and provides for processing even widely differing mail items.

In particular, robot 9:

can be interfaced with numerous stacking devices 3 to reduce overall cost;

provides for firm, safe handling of bundle 4, thus preventing jamming or fall-out of mail items.

Bundle 4 is made immediately available in a standard container, with no manual labour required.

Finally, conveniently emptying out the bundles of mail items automatically enables mail tracking (knowing the content of each container item by item) with no additional checking of the identification codes of the items in the container, in that everything inside the bundling device is transferred to the container. In conventional solutions, on the other hand, in which mail is transferred by hand, the sorter cannot empty the outlet until the end of the process, for reasons of both opportunity and safety (to protect the sorter's fingers from moving parts, safety devices usually prevent easy access to the last items to be inserted, which serve to shield the moving parts).

Figure 6:
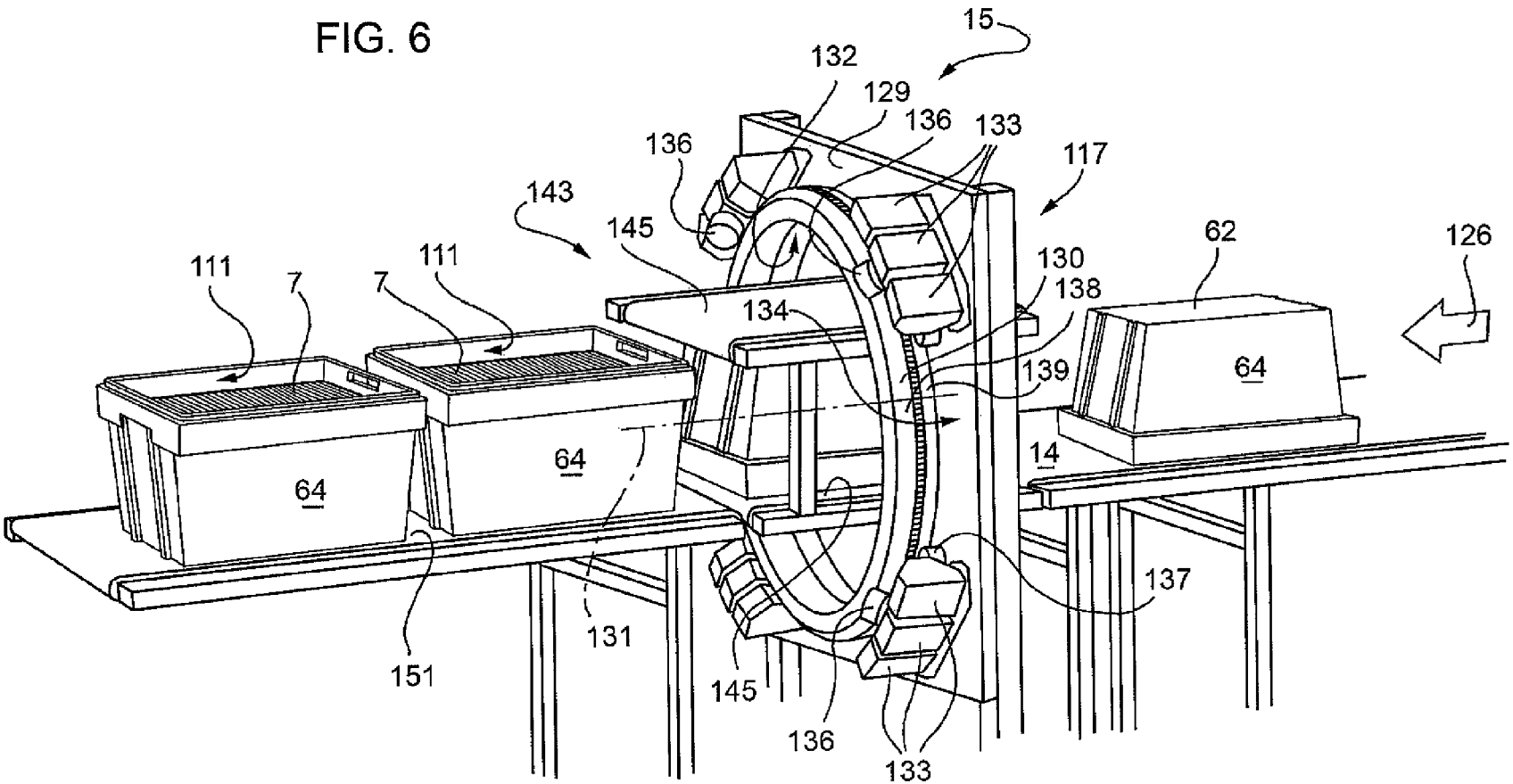
FIGS. 6 and 7 show larger-scale views in perspective of a second detail of the FIG. 1 device.
Figure 7:
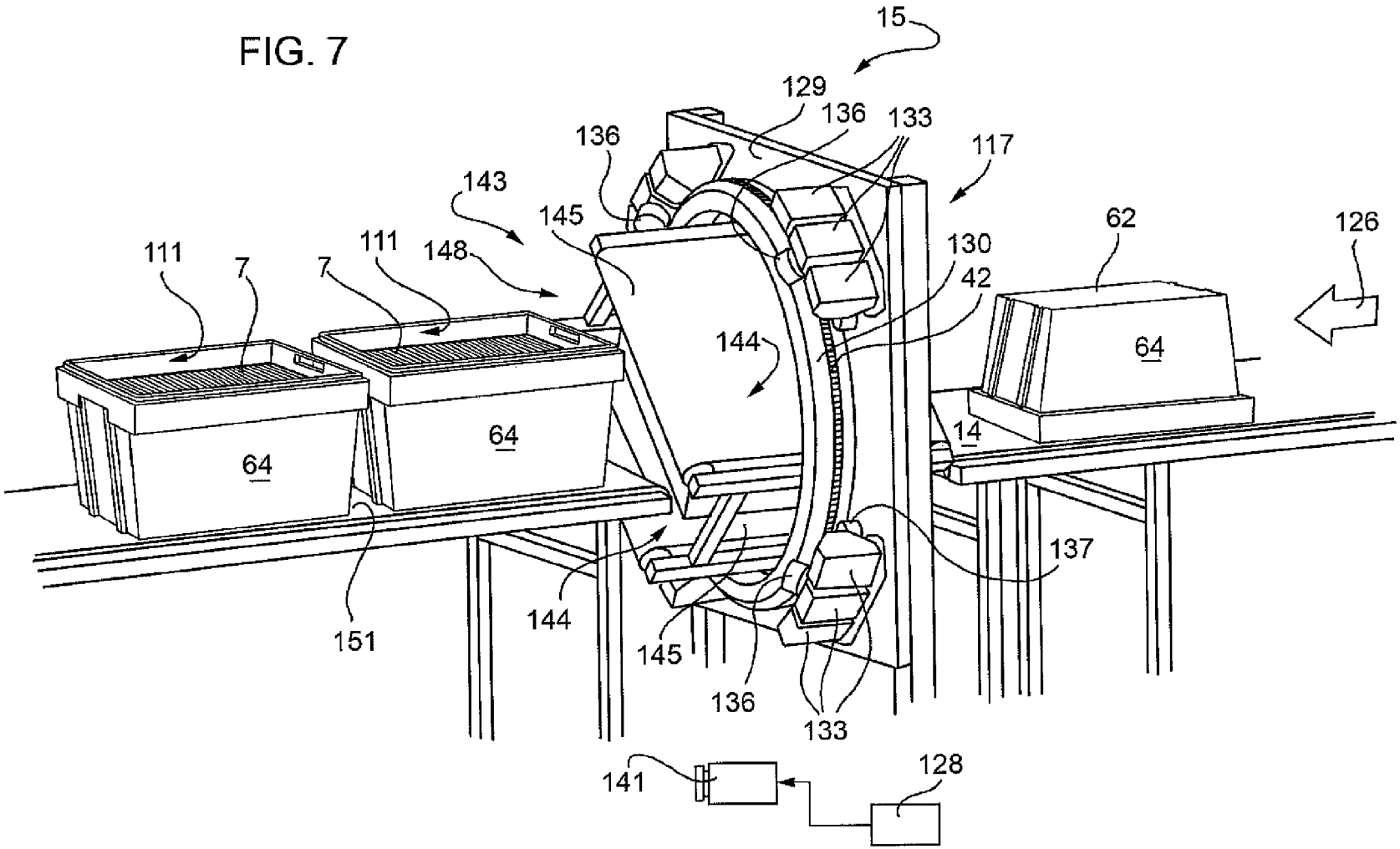

FIGS. 6 and 7 show a detail of turnover device 15 for turning over containers 12, each containing a bundle 4 of mail items 7.

As stated, each container 12 comprises a flat rectangular bottom wall 62 (shown facing upwards in FIG. 6); and four lateral walls 64, the free edges 61 of which define an opening 111 opposite wall 62, and rest on conveyor belt 14.

The height of walls 64 is typically greater than the height of mail items 7.

Device 15 is located at a station 117, at the output of which bundles 4 of mail items 7 are extracted from the containers by the operator OP.

The input of station 117 is defined by conveyor belt 14, onto which the upside down containers 12 have been deposited by covering devices 11 (FIG. 6).

Conveyor belt 14 feeds containers 12 in direction 126 into device 15, and is controlled synchronously with device 15 by a control unit 128 (shown schematically in FIG. 7).

Turnover device 15 comprises a fixed structure 129—in particular, a flat vertical plate—which has a central opening 132 and supports a rim 130 having a substantially horizontal axis 131 parallel to direction 126.

More specifically, rim 130 is coaxial with opening 132, and is fitted with a number of angularly equally spaced supporting bodies 133 arranged in fixed peripheral positions about opening 132.

Bodies 133 projects towards conveyor belt 14 from a vertical face 134 of plate 129, and are fitted with two sets of rollers 136, 137 (shown partly) on opposite axial sides of rim 130.

Rollers 136, 137 roll along respective truncated-cone-shaped outer tracks 138, 139 of rim 130, so rim 130 rotates about axis 131 with respect to plate 129. Preferably, rollers 136, 137 rotate idly with respect to bodies 133, whereas rim 130 is rotated about axis 131 by a motor 141 (shown schematically in FIG. 7) via a transmission comprising outer teeth 42 located axially between tracks 138 and 139, and a pinion (not shown) driven by motor 141 and meshing with teeth 142.

Alternatively, rim 130 is rotated by one or more powered rollers 136, 137.

Motor 141 is fixed with respect to plate 129, is preferably two-way, and is controlled by unit 128 to rotate rim 130 in successive discrete 180° steps.

Rim 130 supports and surrounds a frame 143, which is fixed with respect to rim 130 and supports two powered conveyors 144 comprising respective belts 145.

Conveyors 144 are parallel, and face each other a given distance apart in a direction perpendicular to axis 131 to define the opposite sides of a seat 148 for housing a container 12.

Conveyors 144 rotate together with frame 143 about axis 131, and transfer a container 12 horizontally in an out of seat 148.

In the embodiment shown, conveyors 144 transfer containers 12 in a direction parallel to axis 131 from belt 14 onto a surface 151 located on the opposite side of plate 129 to belt 14 and typically coplanar with the topside surface of belt 14.

In other words, the input and output of seat 148 are preferably on opposite sides along axis 131.

The drive (not shown) of conveyors 144 is preferably fitted to frame 143 and is defined by two separate motor reducers or one motor reducer, and by a transmission between the two conveyors 144. Axis 131 is preferably exactly halfway between belts 145.

In actual use, an upside down container 12 is fed on conveyor belt 14 to seat 148 (FIG. 6), and is eased fully inside seat 148 on one of conveyor belts 145.

During the above operations, frame 143 is in a stable angular position with respect to axis 131 (FIG. 6), and conveyor belt 14 and one of conveyor belts 145 are coplanar.

Once container 12 is seated inside seat 148 (correct seating can be detected by sensors, not shown), control unit 128 activates motor 141 to rotate rim 130 through 180° with respect to plate 129.

Frame 143, conveyors 144, and container 12 are therefore rotated 180°, and container 12 is turned over so its bottom wall 62 rests on the opposite conveyor belt 145 to the one previously supporting it. Rotation is performed at such a speed as not to disturb mail items 7 inside bundle 4.

Following 180° rotation, mail items 7 have one edge 115 resting on wall 62 (FIG. 7) and their peripheral edges facing upwards, and are positioned substantially vertically.

Next, the conveyor belt 145 supporting container 12 is activated to feed container 12 from seat 148 onto surface 151, where it can either be gripped easily by the operator OP or transferred by other conveyor belts to a known container conveyor and sorting system.

The lateral walls of containers 12 are normally lower than the maximum height of mail items 7 in bundle 4.

In which case, the bundle can be custom-shaped as a function of the characteristics of containers 12 and items 7.

For example, in certain conditions produced by the sorting system (a shorter than maximum length bundle 4), by withdrawing paddle 54, even as far as flange 60, once paddle 58 reaches gap 51*b*, items 7 in bundle 4 tilt by force of gravity with respect to wall 50, thus reducing and adapting the height of bundle 4 to the size of the container.

In the case of containers 12 with flared lateral walls, i.e. with an opening larger than bottom wall 62, and a small number of items 7 taller than the walls of container 12 (but flexible enough), an empty container 12 can be applied in a downward movement combined with a longitudinal movement with respect to bundle 4, so as to bend the projecting portions of the taller items 7 to rest container 12 on wall 50.

Wall 50 may also be tub-shaped to complement the portion left exposed by the dropped container 12. In which case, the shallow depth of the tub will be complementary to the height of container 12 with respect to the maximum height of items 7. As it moves along wall 50, bundle 4 drops by gravity into the tub while still retained at the front and rear by paddles 54 and 58, and without being disturbed, since the drop is much smaller than the height of the bundle, and smaller than paddles 54 and 58, which can be rotated appropriately to accompany the movement of the first and last items 7 in bundle 4 respectively.

In the latter case, as well as in all the previous cases, robot 9 may insert a bundle of mail items directly into a container 12 in turnover device 15 (in this case, covering device 11 is integrated). In this case, articulated arm 18 and paddles 54 and 58 must be withdrawn to clear and permit movement of turnover device 15, and belts 13 and 14 are located on either side of wall 50.

FIGS. 8*a*-8*l* show, schematically, operation of the variation in which robot 9 feeds a bundle 4 of mail items directly to turnover device 15.

Figure 8A:
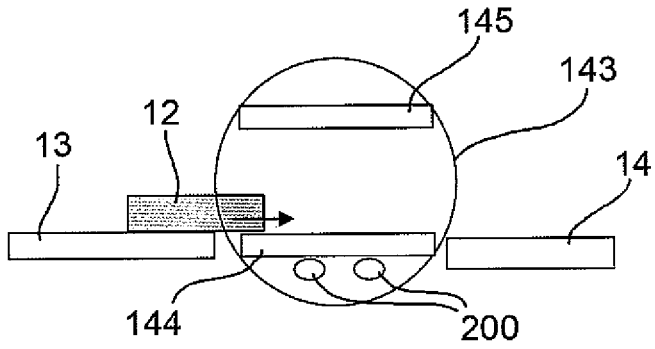
Figure 8B:
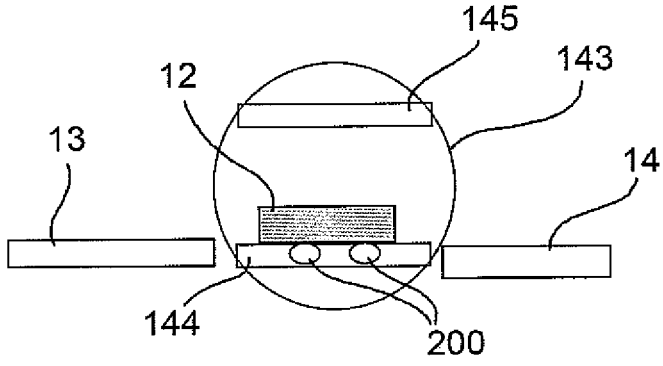
Figure 8C:
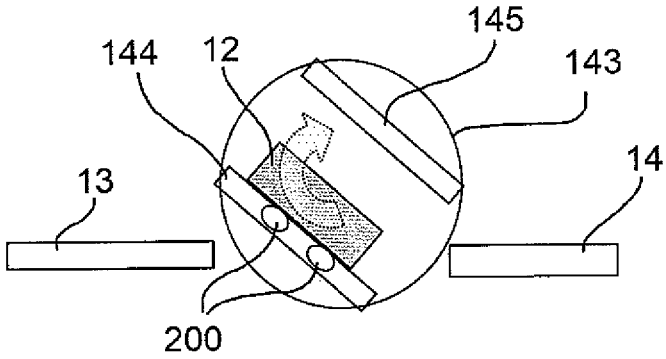
Figure 8D:
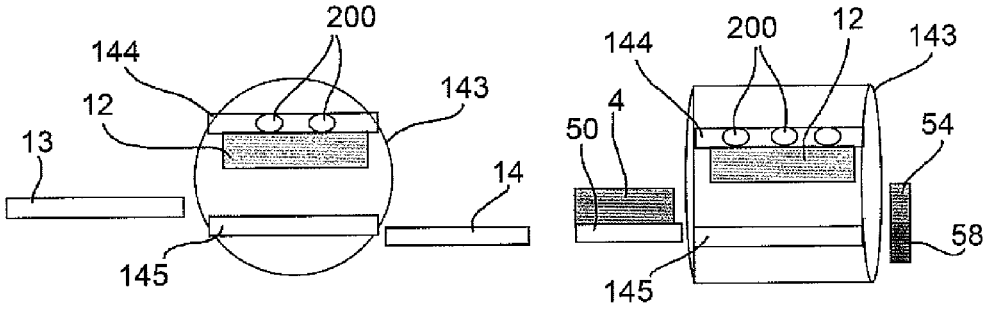
Figure 8E:
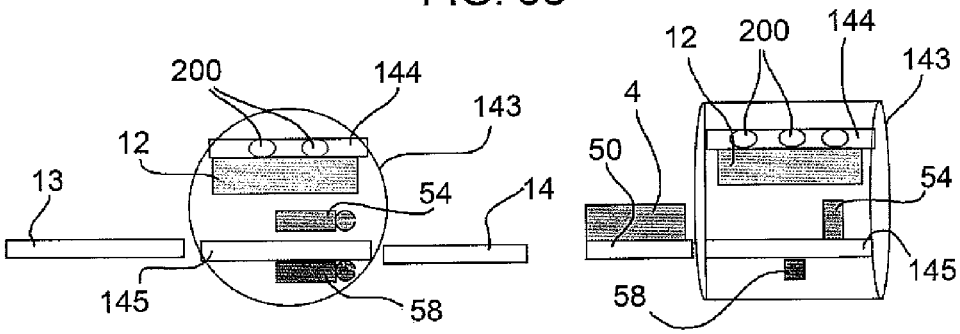
Figure 8F:
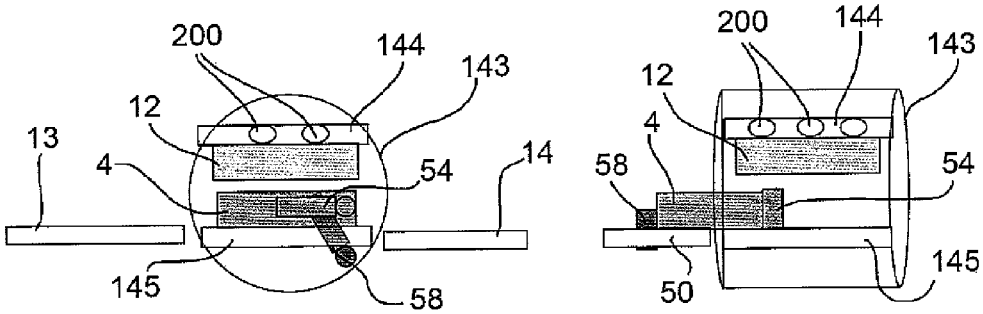
Figure 8G:
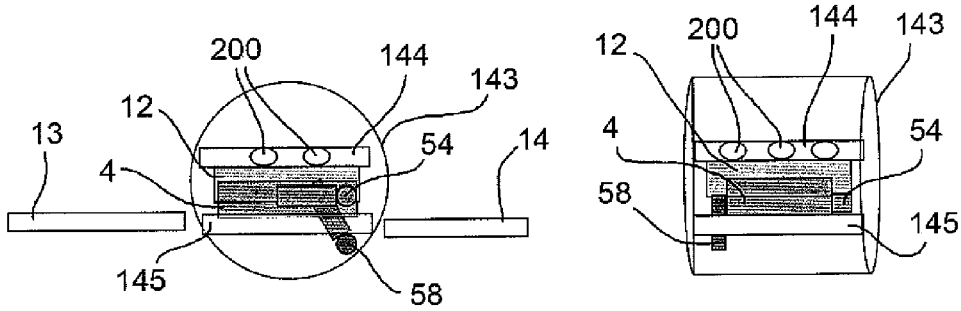
Figure 8H:
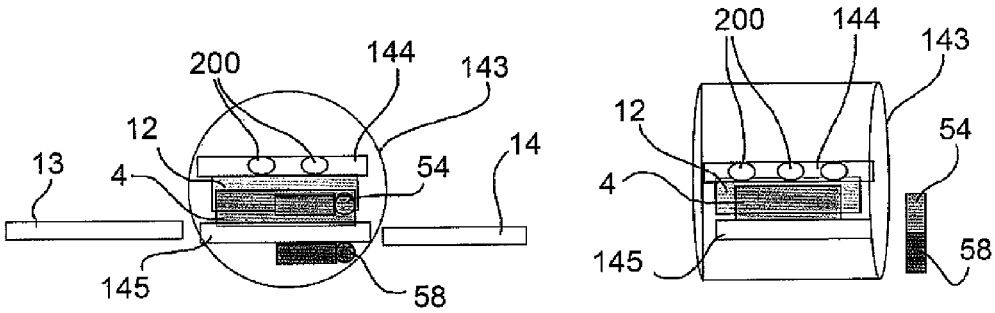
Figure 8I:
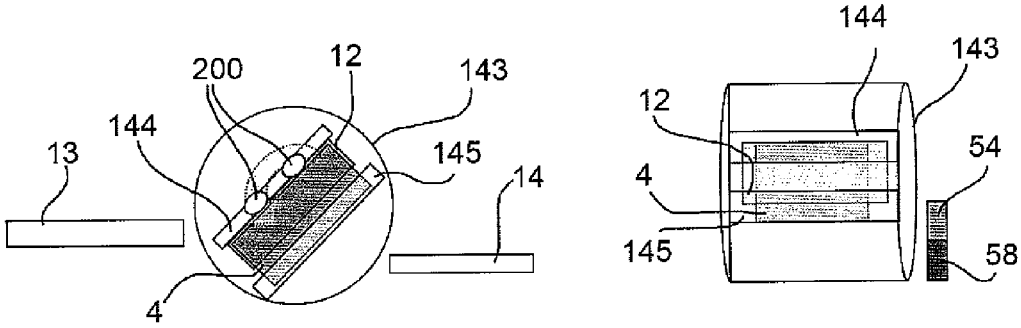
Figure 8J:
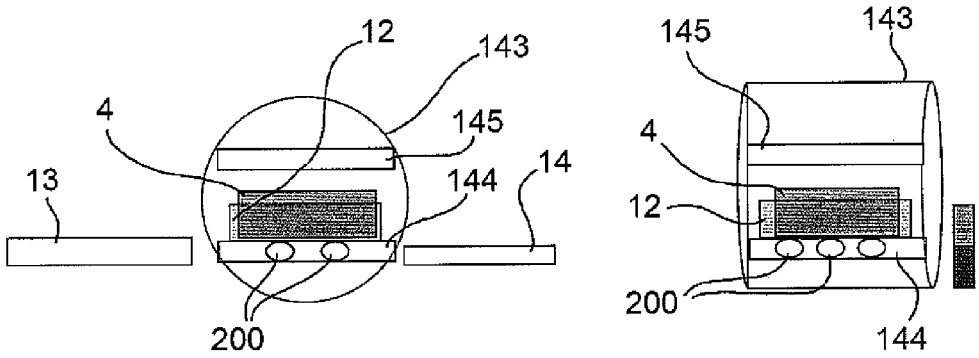
Figure 8L:
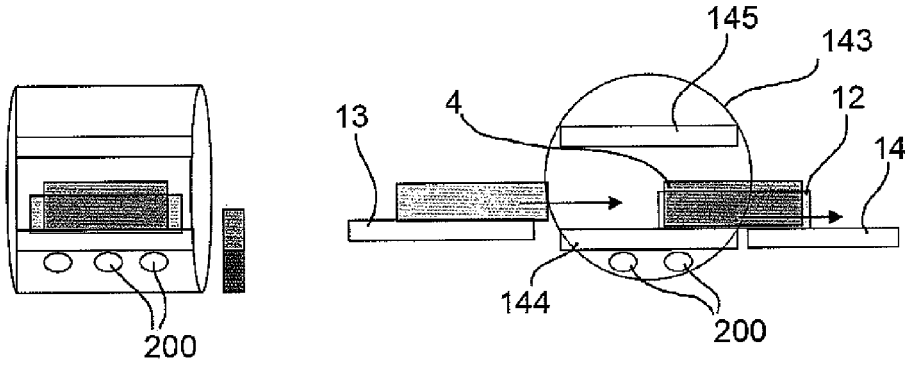

More specifically:

a) an empty container 12 is fed directly by belt 13 into frame 143 (shown schematically by a circle) and onto a first conveyor 144 (FIG. 8*a*);

b) the empty container 12 is connected firmly (e.g. by means of suction cups 200—shown schematically) to the supporting conveyor 144 (FIG. 8*b*);

c) frame 143 is rotated (FIG. 5*c*);

d) frame 143 stops rotating when container 12 is rotated 180° (FIG. 8*d*), i.e. turned over (with the opening of container 12 facing downwards—container 12 is prevented from falling by suction cups 200);

e) during step d), the bundle 4 of mail items rests on rectangular supporting wall 50, and paddles 54 and 58 are outside frame 143 (FIG. 8*d*);

f) paddles 54 and 57 are moved with respect to the initial position (FIG. 8*e*); stop flange 60 is not provided;

g) on engaging bundle 4 in the loading position, paddles 54 and 58 move synchronously to feed bundle 4 into frame 143 (FIG. 8*f*) and onto the opposite conveyor belt 145 to that holding container 12 (FIG. 8*f*);

h) bundle 4 is arrested when it is positioned exactly beneath the upside down container 12;

i) container 12 is placed over bundle 4 (FIG. 8*g*) by moving the edges of container 12, supported by one conveyor 144, onto the other conveyor 144 supporting bundle 4—by the end of this operation (FIG. 8*h*), bundle 4 is housed at least partly inside the cavity defined by container 12;

j) paddles 54 and 58 are rotated to disengage bundle 4, and withdrawn into the initial position outside frame 143 (FIG. 8*h*);

k) frame 143 is rotated 180° (FIG. 8*i*);

l) when the frame stops (FIG. 8*j*), container 12 is positioned with its opening facing upwards, and bundle 4 is housed inside the container;

m) suction cups 200 release the bottom wall of the container (FIG. 8*l*);

n) container 12 is unloaded out of frame 143 and onto conveyor belt 14.

The invention claimed is:

1. A device for processing mail items in bundles, comprising:

at least one stacking device (3) for forming a bundle (4) of said mail items (7) and moving said bundle into a loading position; and pickup and handling means (9, 11, 15) provided to place a container (12) over said bundle (4) so that said bundle (4) being disposed inside said container and container (12) having an opening and to pick up said bundle (4) in said loading position and move said bundle (4) into a covering position;

said stacking device (3) comprising:

at least one substantially horizontal, flat supporting wall (20), on which said bundle (4) being placed;

a front retainer (31) and a rear retainer (32) engaging opposite faces of said bundle (4) to keep said mail items (7) in said bundle (4) substantially perpendicular to said flat supporting wall (20) while being supported by said flat supporting wall (20), wherein said pickup and handling means (9, 11, 15) comprise at least one robot (9) for picking up said bundle (4) in said loading position and moving said bundle (4) into said covering position; and wherein said robot (9) comprises:

at least one substantially horizontal, flat loading wall (50);

a first auxiliary retainer (54) and a second auxiliary retainer (58), which substitute respectively for said front retainer (31) and said rear retainer (32) to retain said bundle as it is moved from said flat supporting wall (20) to said flat loading wall (50);

said first auxiliary retainer (54) and said second auxiliary retainer (58) being movable synchronously by actuating means to transfer said bundle from said flat supporting wall (20) to said flat loading wall (50) by moving said bundle.

2. The device as claimed in claim 1, wherein said front retainer (31) is movable back and forth along said flat supporting wall (20) in a straight direction (D) perpendicular to a plane of said mail items (7).

3. The device as claimed in claim 2, wherein said flat supporting wall (20) is fitted (24) with a straight rail (26) along which said front retainer (31) is movable back and forth.

4. The device as claimed in claim 1, wherein said front retainer (31) is fitted with elastic means and/or a counterweight for moving it into a rest position and so pushing the front retainer, in use, against a front face of said bundle (4).

5. The device as claimed in claim 1, wherein said front retainer (31) is movable angularly between an engaged position, in which a portion of said front retainer facing and close to said flat supporting wall (20) is positioned contacting a front face of said bundle (4), and a release position, in which said front retainer is positioned well clear of said flat supporting wall (20) and detached from said front face of said bundle (4).

6. The device as claimed in claim 1, wherein said front retainer (31) comprises a blade (35).

7. The device as claimed in claim 1, further comprising a side wall (24) extending along an edge (20*a*) of said flat supporting wall (20) and perpendicular to said flat supporting wall (20).

8. The device as claimed in claim 1, wherein said rear retainer (32) comprises a blade (40) positionable contacting a rear face of said bundle (4).

9. The device as claimed in claim 1, wherein said first auxiliary retainer (54) comprises a first paddle (54) fitted to an end of a first movable member (52) that moves axially back and forth with respect to said flat supporting wall (20) to and from said bundle (4);

said second auxiliary retainer (58) comprises a second paddle (58) fitted to an end of a second movable member (56) that moves axially back and forth with respect to said flat supporting wall (20) to and from said bundle (4).

10. The device as claimed in claim 9, wherein said first paddle (54) and said second paddle (58) are located on opposite sides of said flat loading wall (50).

11. The device as claimed in claim 9, wherein said first paddle (54) is movable angularly by said first movable member (52); said first paddle (54) being designed to contact said front retainer (31) to move it from said engaged position to said release position.

12. The device as claimed in claim 9, wherein said second paddle (58) is movable angularly by said second movable member (56) between a first position, and a second position contacting a rear face of said bundle (4).

13. The device as claimed in claim 1, wherein said flat supporting wall (20) and said flat loading wall (50) are substantially coplanar in use.

14. The device as claimed in claim 12, wherein said flat supporting wall (20) and said flat loading wall (50) have respective elongated gaps (22, 51) aligned with each other to permit translation of said second paddle (58) in said second position by said actuating means.

15. A device as claimed in claim 1, wherein said pickup and handling means (9, 11, 15) comprise a covering device (11) for placing an upside down container (12) over said bundle.

16. A device for processing mail items in bundles, comprising:

at least one stacking device (3) for forming a bundle (4) of said mail items (7) and moving said bundle into a loading position; and pickup and handling means (9, 11, 15) provided to place a container (12) over said bundle (4) so that said bundle (4) being disposed inside said container (12) having an opening and to pick up said bundle and container (4) in said loading position and move said bundle (4) into a covering position;

said stacking device (3) comprising:

at least one substantially horizontal, flat supporting wall (20), on which said bundle (4) being placed;

a front retainer (31) and a rear retainer (32) engaging opposite faces of said bundle (4) to keep said mail items (7) in said bundle (4) substantially perpendicular to said flat supporting wall (20) while supported, wherein said pickup and handling means (9, 11, 15) comprise:

at least one robot (9) for picking up said bundle (4) in the loading position and moving it into said covering position.

17. A device for processing mail items in bundles, comprising:

at least one stacking device (3) for forming a bundle (4) of said mail items (7) and moving said bundle into a loading position; and pickup and handling means (9, 11, 15) provided to place a container (12) over said bundle (4) so that said bundle (4) being disposed inside said container (12) having an opening and to pick up said bundle and container (4) in said loading position and move said bundle (4) into a covering position;

said stacking device (3) comprising:

at least one substantially horizontal, flat supporting wall (20), on which said bundle (4) being placed;

a front retainer (31) and a rear retainer (32) engaging opposite faces of said bundle (4) to keep said mail items (7) in said bundle (4) substantially perpendicular to said flat supporting wall (20) while supported, wherein said pickup and handling means (9, 11, 15) comprise a turnover device (15) for turning the containers (12) over through substantially 180° , so the containers (12) housing respective bundles (4) are positioned with their respective openings upwards.

18. A device as claimed in claim 17, wherein said turnover device (15) is located along a conveying system (14) supplied by the covering device (11) with bundles (4) of mail items covered with respective upside down containers (12).

19. A device as claimed in claim 16, and comprising a number of stacking devices (3) wherein said robot (9) is movable with respect to said stacking devices (3) to engage one stacking device (3) at a time.

20. A device as claimed in claim 16, wherein said robot is fitted to said covering device (11), which is movable with respect to said stacking devices (3).

21. A device as claimed in claim 16, wherein said covering device (11) comprises an articulated arm (18) with gripping members (19) for engaging an upside down container;

said robot (9);

a supporting surface (19*b*) having a supporting portion (50) that can be positioned adjacent to a selected said stacking device; said robot (9) moving said bundle from said stacking device from the loading position to the covering position;

said articulated arm (18) being movable into a position in which said upside down container is lowered over said bundle in said covering position;

said articulated arm (18) also being movable to transfer the upside down container containing said bundle to a conveying system (14), by sliding it along said supporting surface.

22. A device as claimed in claim 21, wherein said articulated arm is movable angularly with respect to a substantially vertical axis (V) of the covering device (11).

23. A device as claimed in claim 21, and comprising a conveyor belt feed system associated with said covering device (11) and for supplying empty containers for pickup by said gripping members (19).

24. A device as claimed in claim 1, wherein said pickup and handling means (9, 11, 15) place the bundle (4) inside said container (12) after making a straight translatory movement of said bundle (4), and a straight translatory movement of a container (12) in a direction crosswise to the plane of the bundle.

* * * * *